United States Patent [19]

Coster

[11] 4,114,964

[45] Sep. 19, 1978

[54] MODULE FOR FORMING ARTICLES OF FURNITURE

[76] Inventor: Charles S. Coster, Main St., Stockbridge, Mass. 01262

[21] Appl. No.: 798,000

[22] Filed: May 18, 1977

[51] Int. Cl.[2] ..... A47B 53/00

[52] U.S. Cl. ..... 312/198; 52/DIG. 10; 5/357

[58] Field of Search ..... 5/357, 341; 312/198; 52/DIG. 10

[56] References Cited

U.S. PATENT DOCUMENTS

| | | | |
|---|---|---|---|
| 3,469,882 | 9/1969 | Larsen | 5/357 |
| 3,555,581 | 1/1971 | Friant | 5/357 |
| 3,556,593 | 10/1968 | Speegle | 52/DIG. 10 |
| 3,625,195 | 12/1971 | Grall | 52/DIG. 10 |
| 3,665,882 | 5/1972 | Georgiev | 52/DIG. 10 |
| 3,746,345 | 7/1973 | Palazzolo | 52/DIG. 10 |
| 3,968,529 | 7/1976 | Levin et al. | 5/341 |

*Primary Examiner*—Mervin Stein
*Assistant Examiner*—Victor N. Sakran
*Attorney, Agent, or Firm*—Charles E. Temko

[57] ABSTRACT

A foldable module comprising a plurality of substantially similar, hollow pyramidal elements, at least some of which lack a single tapering side wall so as to provide access to the interior thereof. The elements are foldably interconnected, preferably in linear arrangement along opposed side edges of the base walls thereof, and may be mutually oriented to a variety of positions depending upon contemplated use.

1 Claim, 5 Drawing Figures

MODULE FOR FORMING ARTICLES OF FURNITURE

BACKGROUND OF THE INVENTION

This invention relates generally to the field of modular furniture, and more particularly to an improved module which may be employed to form a variety of pieces of furniture depending upon desired use or decorative appearance.

It is known in the art to form articles of furniture using standardized modular components of uniform width or other dimension, the modules being interconnected using screws or other fastening means to form such articles as storage walls, unitary table and chair combinations, and the like. Such constructions are usually assembled from separate elements and require the use of tools for such assembly. Additionally, because such elements are normally of rectangular configuration, the number of possible combinations are limited to generally rectangular furniture pieces which are, from a decorative standpoint, scarcely distinguishable from conventional furniture constructions.

SUMMARY OF THE INVENTION

Briefly stated, the invention contemplates the utilization of the distinctive geometric properties of a group of quadrilateral pyramids which are foldably interconnected along oppositely disposed side edges of the base walls thereof. By arranging the interconnected pyramidal elements in a variety of relative positions, it is possible to form a relatively large number of distinctive shapes which are suitable for use as cocktail tables, magazine storage racks, end tables and various combinations thereof. At least some of the individual elements, and preferably all of such units, are formed to include an opening formed by the elimination of one triangular wall leading to the interior space enclosed by the remaining walls. The modules may be formed from a variety of materials, depending upon considerations of weight, cost, durability, appearance and mechanical strength.

BRIEF DESCRIPTION OF THE DRAWING

In the drawing, to which reference will be made in the accompanying specification, similar reference characters have been employed to designate corresponding parts throughout the several views.

DETAILED DESCRIPTION OF THE DISCLOSED EMBODIMENT

Figure 1:
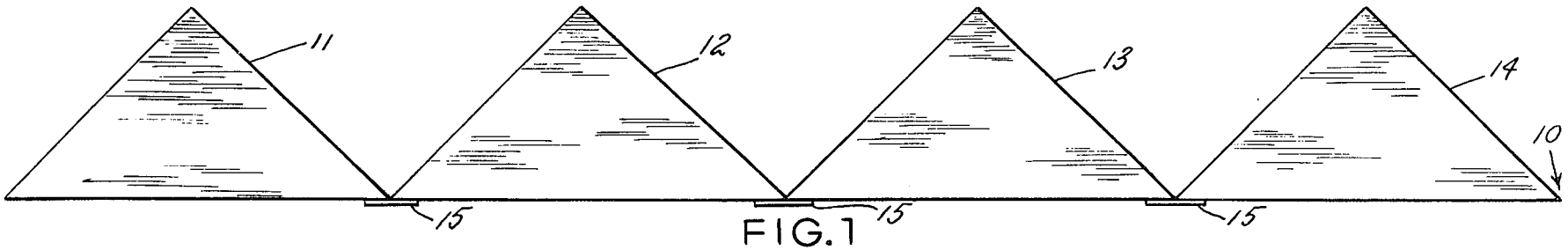
FIG. 1 is a side elevational view of an embodiment of the invention.

In accordance with the invention, the device, generally indicated by reference character 10, comprises broadly: first, second, third and fourth pyramidally shaped elements, 11, 12, 13 and 14, respectively. The elements 11–14 are interconnected as seen in FIG. 1 by a plurality of foldable interconnecting means 15 to permit relative pivotal movement wherein the individual surfaces of the elements may be placed in an abutted relation relative to corresponding surfaces on adjacent units.

As the elements 12–14 are substantially similar, and, as a practical matter, identical, a description of one of such elements will serve to describe all. Each includes a rectangular base wall 11, bounded by first, second, third and fourth edges 18, 19, 20 and 21, respectively, an outer surface 22 and an inner surface 23.

Extending from at least three of the edges 18–21, inclusive, are first, second and third triangularly shaped walls 24, 25 and 26, respectively, each being bounded by a base edge 27 and a pair of converging edges 28 and 29 meeting at an apex 30, and enclosing an outer surface 31 and inner surface 32. While, if desired, it is possible to provide a fourth wall (not shown), the elimination of one wall provides access to the space enclosed by the remaining walls, thereby permitting an individual element to offer storage space, depending upon the location of the element within the article of furniture formed.

The foldable interconnecting means 15 is illustrated in the drawing in the form of an adhesive tape of mylar or similar synthetic material. This is particularly suitable where the elements 11–14 are molded from synthetic resinous transparent or opaque materials. Where a more inexpensive construction is required, it is possible to die-cut a blank of cardboard material from which all four elements are subsequently formed in interconnected relation, the foldable interconnecting means, in that case, being merely a scored or perforated portion of stock interconnecting unsevered portions of the base walls of each element. Where a particularly strong construction is desired, metallic hinge means may also be employed.

Figure 4:
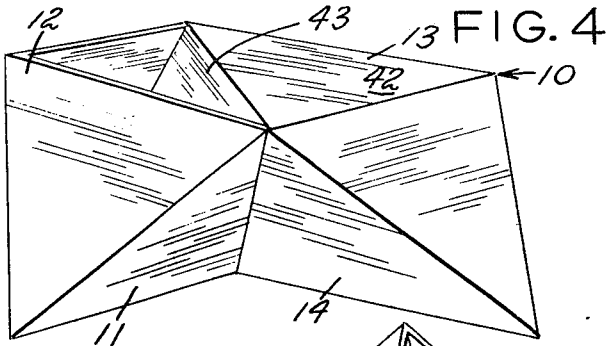
FIG. 4 is a view in perspective of a first article of furniture formed using the structure shown in FIG. 1.
Figure 2:
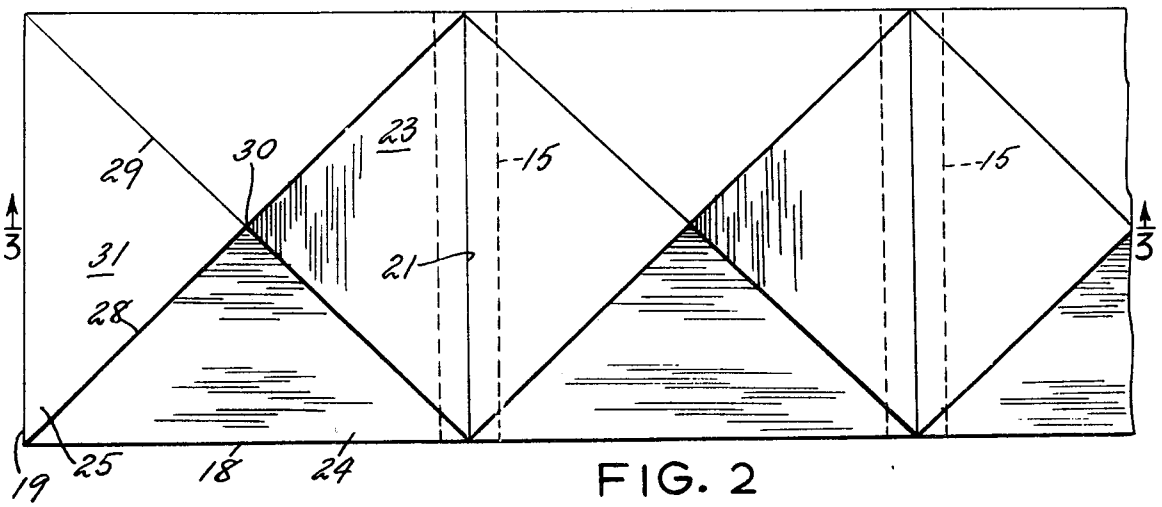
FIG. 2 is a fragmentary top plan view thereof.

FIG. 4 illustrates one possible configuration obtained by folding the elements 11–14 about the interconnecting members 15 and positioning the same on a horizontal surface such that the elements 12 and 13 are uppermost, this arrangement forming a cocktail table of attractive appearance. The table offers a table surface 42 formed by one of the triangular walls, and a storage recess 43 accessible through the opening formed by the elimination of one triangular wall.

Figure 5:
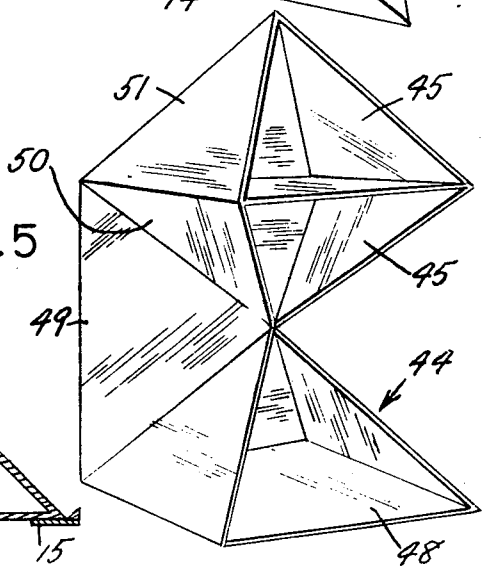
FIG. 5 is a view in perspective of a modified form of the embodiment in folded condition to form a second article of furniture.
Figure 3:
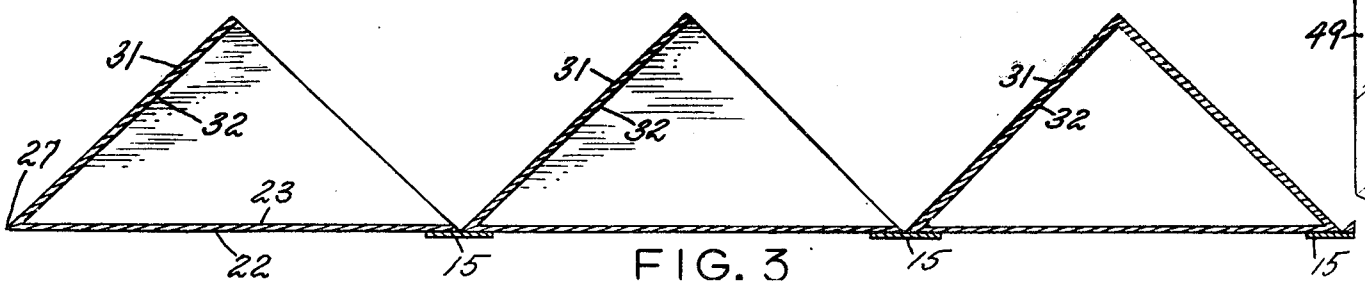
FIG. 3 is a longitudinal sectional view thereof as seen from the plane 3—3 in FIG. 2.

FIG. 5 illustrates a modified form of the invention, generally indicated by reference character 44, the modified form being characterized in the positioning of a pair of openings 45, each adjacent a foldable interconnecting means. The elements are folded such that three adjacent elements abut triangular walls thereof, and a fourth element is folded through substantially 180° such that the outer surfaces of the base wall are positioned in juxtaposed relation. The folded device is then positioned in vertical orientation upon a floor or other horizontal supporting surface, so that one element 48 forms a base, a second element 49 a vertical support, and third and fourth elements 50 and 51, respectively, form an upper portion of a table.

It will be apparent that by simple modification of the location of the opening in each unit, other combinations are possible. For example, the folding of the four elements such that the triangular surfaces of each are abutted will result in a generally rectangular boxlike structure suitable for use as a stool. The structure illustrated in FIG. 4 may be rotated about a horizontal axis through 180° to result in an equally attractive cocktail table of somewhat different configuration.

I wish it to be understood that I do not consider the invention limited to the precise details of structure shown and set forth in this specification, for obvious modifications will occur to those skilled in the art to which the invention pertains.

I claim:

1. An improved module for forming articles of furniture comprising: a plurality of hollow quadrilateral pyramidally shaped elements, each element having a square base wall and three equilateral triangular side walls converging to an apex from three sides of said base to define a triangularly-shaped opening affording access to the interior of said element from a fourth side of said base wall; said elements each being foldably interconnected along an edge of said base wall thereof to permit relative pivotal movement wherein a base wall or a triangular wall of each of said elements may be selectively placed in abutted relation relative to a corresponding wall of an adjacent interconnected element to form a desired configuration in which at least one of said triangularly shaped openings is exposed whereby articles may be stored, when one surface of said configuration is supported upon a horizontally disposed floor.

* * * * *